US009304424B2

(12) United States Patent
Ishikawa

(10) Patent No.: US 9,304,424 B2
(45) Date of Patent: Apr. 5, 2016

(54) IMAGE FORMING APPARATUS

(71) Applicants: Kabushiki Kaisha Toshiba, Minato-ku, Tokyo (JP); Toshiba TEC Kabushiki Kaisha, Shinagawa-ku, Tokyo (JP)

(72) Inventor: Satoshi Ishikawa, Shizuoka-ken (JP)

(73) Assignees: KABUSHIKI KAISHA TOSHIBA, Tokyo (JP); TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/164,531

(22) Filed: Jan. 27, 2014

(65) Prior Publication Data

US 2014/0212157 A1 Jul. 31, 2014

(30) Foreign Application Priority Data

Jan. 31, 2013 (JP) ..... 2013-017640

(51) Int. Cl.
*G03G 9/09* (2006.01)
*G03G 13/22* (2006.01)

(52) U.S. Cl.
CPC ..... *G03G 9/09* (2013.01); *G03G 9/0926* (2013.01); *G03G 13/22* (2013.01)

(58) Field of Classification Search
CPC combination set(s) only.
See application file for complete search history.

(56) References Cited

U.S. PATENT DOCUMENTS

2010/0290812 A1* 11/2010 Taguchi et al. ..... 399/223
2012/0038941 A1 2/2012 Megawa

FOREIGN PATENT DOCUMENTS

| | | |
|---|---|---|
| JP | 2000-246999 | 9/2000 |
| JP | 2011-165199 | 8/2011 |
| JP | 2012-037885 | 2/2012 |
| JP | 2012-140005 | 7/2012 |

OTHER PUBLICATIONS

Final Office Action for Japanese Patent Application No. 2013-017640 dated Jun. 9, 2015, 6 pages.

* cited by examiner

*Primary Examiner* — Clayton E LaBalle
*Assistant Examiner* — Jas Sanghera
(74) *Attorney, Agent, or Firm* — Amin, Turocy & Watson LLP; Gregory Turocy

(57) ABSTRACT

In accordance with one embodiment, an image forming apparatus comprises a first image forming unit, a second image forming unit and a processing unit. The first image forming unit forms an image using an erasable image forming material. The second image forming unit forms an image using an inerasable image forming material. The processing unit forms an image to be printed using an erasable image forming material with the first image forming unit, and forms a specific pattern for duplication prevention using an inerasable image forming material with the second image forming unit.

12 Claims, 4 Drawing Sheets

IMAGE FORMING APPARATUS

CROSS-REFERENCE TO RELATED APPLICATION

This application is based upon and claims the benefit of priority from Japanese Patent Application No. 2013-017640, filed Jan. 31, 2013, the entire contents of which are incorporated herein by reference.

FIELD

Embodiments described herein relate to an image forming apparatus.

BACKGROUND

Conventionally, there is an image forming apparatus which forms an image using an image forming material which can be erased through an erasing processing. Further, the image forming apparatus forms a specific pattern such as a ground pattern as well as the image to protect the image which needs protection on, such as duplication prohibition. However, in practical processing, the erasable image forming material cannot be completely erased and may have erasing residues sometimes. If the specific pattern is erased while part of the image which needs protection is left on a paper in a duplicable state after the erasing processing, the part of the image which needs protection may be illegally duplicated.

DETAILED DESCRIPTION

In accordance with one embodiment, an image forming apparatus comprises a first image forming unit, a second image forming unit and a processing unit. The first image forming unit forms an image using an erasable image forming material. The second image forming unit forms an image using an inerasable image forming material. The processing unit forms an image to be printed using an erasable image forming material with the first image forming unit, and forms a specific pattern for duplication prevention using an inerasable image forming material with the second image forming unit.

Hereinafter, embodiments are described with reference to accompanying drawings.

Figure 1:
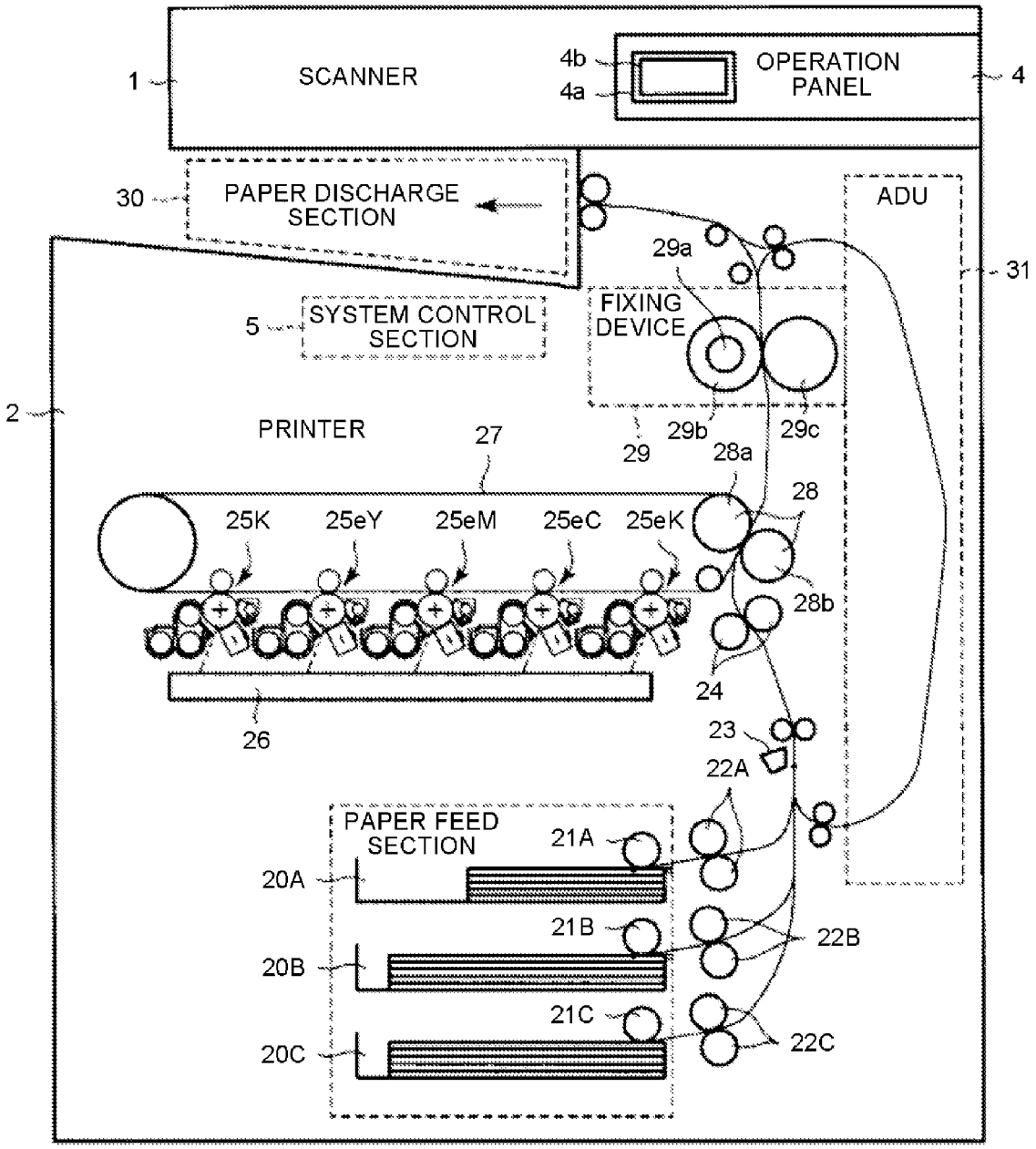
FIG. 1 is a cross-sectional view schematically illustrating a constitution example of a digital multi-functional peripheral according to an embodiment.

FIG. 1 is a cross-sectional view schematically illustrating a constitution example of a digital multi-functional peripheral according to the embodiment. The digital multi-functional peripheral (MFP) according to the present embodiment functions as an image erasing apparatus and an image forming apparatus. As shown in FIG. 1, the digital multi-functional peripheral comprises a scanner 1, a printer 2, an operation panel 4 and a system control section 5.

The scanner 1 reads an image of a document and converts the image into image data. The scanner 1 consists of, for example, a CCD line sensor and the like for converting the image on a reading surface of the document into image data. The scanner 1 may be a scanner for scanning the document placed on a document table glass, or a scanner for reading the image of the document conveyed by an auto document feeder (ADF). The scanner 1 is arranged, for example, at an upper portion of a main body of the digital multi-functional peripheral. The scanner 1 is controlled by the system control section 5, and outputs the image data of the document to the system control section 5.

The printer 2 has an image forming function (a function as an image forming apparatus) of forming an image on a paper serving as an image formed medium and an image erasing function (a function as an image erasing apparatus) of erasing the image printed on a paper. The printer 2 functioning as an image forming apparatus has a function of forming an image using an color erasable toner serving as an image forming material which can be erased through the image erasing function, and a function of forming an image using general toner serving as an image forming material which cannot be erased through the image erasing function. Further, the printer 2 has a function (function of overprinting a color erasable toner image and a general toner image) of forming an image with color erasable toner and forming an image with a general toner on one same paper.

In the constitution example shown in FIG. 1, the printer 2 includes paper feed cassettes 20 (20A, 20B and 20C). For example, each paper feed cassette 20A, 20B, 20C is detachably arranged at the lower portion of the main body of the digital multi-functional peripheral. These paper feed cassettes 20A, 20B, 20C store papers serving as image formed media printed with images. The paper feed cassettes 20A, 20B, 20C store not only a new paper (a paper to be not subjected to image erasing processing) formed with an image through the image forming function, but also a paper (a paper to be subjected to image erasing processing) printed with an image which can be erased through the image erasing function. For example, as an operation form, a first paper feed cassette stores a new paper, a second paper feed cassette stores a paper to be subjected to color erasing processing, and a third cassette stores a paper with a size different from the size of the papers stored in the first and second paper feed cassettes. Further, the paper feed cassettes may also store a new paper and a paper (a paper printed with a color erasable image) to be subjected to color erasing processing in a mixed manner.

Each paper feed cassette 20A, 20B, 20C comprises a pickup roller 21A, 21B, 21C respectively. The pickup rollers 21A, 21B, 210 take out papers one by one from each paper feed cassette 20A, 20B, 20C, and feed the taken out papers towards a conveyance path (conveyance section) 22 consisting of a plurality of conveyance rollers and the like. The number of the paper feed cassettes serving as paper feed sections and the pickup rollers is not limited to 3. For example, the number of the paper feed cassettes and the pickup rollers may be set to 1 or 2, or more than 3. Further, the paper feed section, which is not limited to be a paper feed cassette, may also be a manual feeding tray.

The conveyance section 22 conveys a paper in inside the printer 2. The conveyance section 22 conveys the papers fed by the pickup rollers 21A, 21B, 21C to an image reading position of a scanner 23. And then the conveyance section 22 conveys the paper passing through the image reading position of the scanner 23 towards a register roller 24. The register roller 24 conveys, in a case of forming an image on a paper, the paper to a transfer position at an image transfer timing. However, in a case of not forming an image on a paper (for example, in a case of erasing the image printed on a paper, or in a case of rejecting a paper), the register roller 24 serves as one conveyance roller constituting the conveyance section 22, and conveys the paper.

The scanner 23 is an image reading section consisting of a CCD line sensor and the like. The scanner 23 reads an image on a surface of a paper conveyed by the conveyance section 22 at a specific image reading position. The paper fed from the paper feed cassettes 20 or a paper resupplied by an ADO 31 which will be described later is conveyed to the image reading position of the scanner 23. The scanner 23 functions as a second image reading unit reading an image on a surface of the paper fed from the paper feed cassettes 20, and further functions as an image reading unit reading an image on a surface of a paper (a paper subjected to color erasing processing) resupplied by the ADU 31.

Image forming sections 25 (25*e*Y, 25*e*M, 25*e*C, 25*e*K, 25K), an exposure section 26, an intermediate transfer belt 27 and a transfer section 28 function as an image forming unit which operates in a case of forming an image on a paper. In a case of erasing an image printed on a paper conveyed from the register roller 24 instead of forming an image on the paper (that is, in a case where the image erasing function is being operated), the image forming sections 25 (25*e*Y, 25*e*M, 25*e*C, 25*e*K, 25K), the exposure section 26, the intermediate transfer belt 27 and the transfer section 28 do not carry out any operation relating to printing, and the transfer section 28 only functions as a conveyance roller.

The image forming sections 25 (25*e*Y, 25*e*M, 25*e*C, 25*e*K, 25K) form an image to be transferred to the paper. For example, the image forming sections 25*e*Y, 25*e*M, 25*e*C, 25*e*K form an image with a toner the color of which can be erased (referred to as color erasable toner). The image forming section 25K forms an image with a toner the color of which cannot be erased (referred to as general toner). The image forming sections 25 according to the present embodiment comprises an image forming section using a color erasable toner (a first image forming section) which forms an image with a color erasable toner, and an image forming section using a general toner (a second image forming section) which forms an image with a general toner. In addition, the first image forming section (the image forming section using a color erasable toner) may be a section for forming a colorized color erasable toner image, or a section for forming a monochrome color erasable toner image. Further, the second image forming section (the image forming section using a general toner) may be a section for forming a colorized general toner image, or a section for forming a monochrome general toner image.

In the constitution example shown in FIG. 1, the image forming sections 25*e*Y, 25*e*M, 25*e*C, 25*e*K constitute the first image forming section (the image forming section using a color erasable toner). The image forming sections 25*e*Y, 25*e*M, 25*e*C, 25*e*K serving as the first image forming section form an image with color erasable toners of different colors. The image forming section 25K constitutes the second image forming section (the image forming section using general toner). The image forming section 25K forms an image with monochrome general toner. In the constitution example shown in FIG. 1, the image forming section 25*e*Y forms an image with yellow color erasable toner. The image forming section 25*e*M forms an image with magenta color erasable toner. The image forming section 25*e*C forms an image with cyan color erasable toner. The image forming section 25*e*K forms an image with black color erasable toner. The image forming section 25K forms an image with monochrome general toner.

The exposure section 26 forms an electrostatic latent image on a photoconductive drum (image carrier) of each image forming section 25 (25*e*Y, 25*e*M, 25*e*C, 25*e*K, 25K) through a laser light. The exposure section 26 irradiates, through an optical system such as a polygon mirror and the like, the photoconductive drum with a laser light controlled in response to the image data. The laser light from the exposure section 26 forms an electrostatic latent image on the surface of each photoconductive drum. The exposure section 26 controls the laser light in response to a control signal from the system control section 5. The electrostatic latent image formed on each photoconductive drum is an image which can be developed by the color erasable toner of each color or the general toner. For example, the exposure section 26 controls the power of the laser light in response to the control signal from the system control section 5. Further, the exposure section 26 also controls, in response to the control signal from the system control section 5, the modulation quantity of the pulse width and the like for controlling the light emitting of the laser light.

Each image forming section 25 (25*e*Y, 25*e*M, 25*e*C, 25*e*K, 25K) develops the electrostatic latent image formed on the photoconductive drum thereof with each toner (color erasable toner of each color, general toner). Each image forming section 25 (25*e*Y, 25*e*M, 25*e*C, 25*e*K, 25K) forms a toner image (color erasable toner image, general toner image) serving as a visible image on the photoconductive drum. The intermediate transfer belt 27 is an intermediate transfer body. Each image forming section 25 (25*e*Y, 25*e*M, 25*e*C, 25*e*K, 25K) transfers (primarily transfer) the toner image formed on the photoconductive drum to the intermediate transfer belt 27. Each image forming section 25 (25*e*Y, 25*e*M, 25*e*C, 25*e*K, 25K) applies a transfer bias to the toner image formed with the color erasable toner or the general toner at a primary transfer position. Each image forming section 25 (25*e*Y, 25*e*M, 25*e*C, 25*e*K, 25K) controls the transfer bias through transfer current. The toner image on each photoconductive drum is transferred to the intermediate transfer belt 27 through the transfer bias at the primary transfer position thereof. The system control section 5 controls the transfer current which is used by each image forming section in the primary transfer processing.

Further, each image forming section 25*e*Y, 25*e*M, 25*e*C, 25*e*K, 25K has a sensor such as a potential sensor, a concentration sensor and the like respectively. The potential sensor is a sensor detecting the surface potential of the photoconductive drum. In each image forming section 25*e*Y, 25*e*M, 25*e*C, 25*e*K, 25K, a charging charger charges the surface of the photoconductive drum before it is exposed by the exposure section 26. The system control section 5 can change the charging condition based on the charging charger. The potential sensor detects the surface potential of the photoconductive drum the surface of which is charged by the charging charger. The concentration sensor detects the concentration of the toner image transferred to the intermediate transfer belt 27. Further, the concentration sensor may also be a sensor detecting the concentration of the toner image formed on the photoconductive drum.

Further, in a case where a color image is formed with a color erasable toner, each image forming section 25*e*Y, 25*e*M, 25*e*C, 25*e*K serving as the first image forming section superimposes and transfers (primarily transfer) the toner image (visible image) developed with the color erasable toner of each color (yellow, magenta, cyan, black) to the intermediate transfer belt 27. As a result, the intermediate transfer belt 27 holds a color image (color image formed with color erasable toner) obtained by overlapping the color erasable toner images of each color. Further, in a case of forming and superimposing an image formed with a general toner on the image formed with color erasable toner, the image forming section 25K serving as the second image forming section superimposes and transfers (primarily transfer) the toner image (visible image) developed with the general toner to the intermediate transfer belt 27 transferred with a color erasable toner image. As a result, the intermediate transfer belt 27 holds an image obtained by overlapping the general toner image on the color erasable toner image.

The transfer section 28 transfers the toner image (color erasable toner image or general toner image) on the intermediate transfer belt 27 to a paper at a secondary transfer position. The secondary transfer position is a position where the toner image on the intermediate transfer belt 27 is transferred to the paper. The secondary transfer position is a position where a support roller 28*a* and a secondary transfer roller 28*b* are opposed. The transfer section 28 applies a transfer bias which is controlled through transfer current at the secondary transfer position. The transfer section 28 transfers the toner image (color erasable toner image or general toner image) on the intermediate transfer belt 27 to the paper through the transfer bias. The system control section 5 controls the transfer current which is used in a secondary transfer processing. For example, the system control section 5 may respectively control the transfer current in a case of transferring the color erasable toner image and the transfer current in a case of transferring the general toner image.

A fixing device 29 has a fixing processing function (a function as a fixing section) of fixing the toner on the paper and a color erasing processing function (a function as a color erasing section) of erasing the image on the paper as a color erasing unit. In the embodiment, the fixing device 29 erases the color erasable toner image on the paper through the heat applied to the paper. However, the erasing (color erasing) section is not limited to the section which erases an image by heating. For example, the erasing (color erasing) section may also be a section which erases an image by stripping the image forming material off from the paper surface, or a section which erases an image by chemically decoloring the image forming material on the paper. That is, the image forming apparatus may be an apparatus arranged with a fixing section for fixing the toner image and an erasing (color erasing) section for erasing the image. In addition, in the present embodiment, it is assumed that the fixing device 29 functions as a color erasing section.

The fixing device 29 has a constitution of applying heat to a paper for carrying out a fixing processing or color erasing processing by heating. In the constitution example shown in FIG. 1, the fixing device 29 consists of a heating roller 29*b* in which a heating section 29*a* is arranged and a pressing roller 29*c* which contacts with a fixing belt heated by the heating roller 29*b* in pressure. The heating section 29*a* may be a temperature controllable heater. For example, the heating section 29*a* may be a heater consisting of a heater lamp such as a halogen lamp and the like, or an induction heating (IH) type heater. Further, the heating section 29*a* may also consist of a plurality of heaters. In addition, the fixing device 29 may also be a constitution in which a fixing device for the fixing processing of fixing the toner image on the paper and a fixing device for the color erasing processing of erasing the color erasable toner image are respectively arranged.

The fixing device 29 having a constitution described above can be controlled to a fixing temperature used in the fixing processing or a color erasing temperature used in the color erasing processing by the system control section 5. However, at least the fixing temperature at which the color erasable toner is fixed on the paper and the color erasing temperature at which the color erasable toner image on the paper is erased are set to be different from each other. Further, the paper, which is not to be subjected to image forming (printing) processing and color erasing processing, is passed through the fixing device 29 without carrying out image forming processing and color erasing processing, and then discharged to a paper discharge section 30.

For example, in a case of carrying out the fixing processing of fixing the toner image on the paper, the system control section 5 controls the fixing device 29 to the fixing temperature. The fixing device 29 controlled to the fixing temperature presses and heats the paper to which the toner image is transferred by the transfer section 28 at the fixing temperature. In this way, the fixing device 29 fixes the toner image on the paper. Further, the fixing device 29 conveys the paper subjected to fixing processing to the paper discharge section 30 or the automatic double-sided unit (ADU) 31. In a case of forming an image on the back side of the paper which is subjected to fixing processing by the fixing device 29, the paper is temporarily conveyed to the side of the paper discharge section 30, and then switched back and conveyed to the ADU 31. In this case, the ADU 31 conveys the paper which is inverted through the switchback to the register roller 24 again.

Further, in a case of carrying out the color erasing processing of erasing the color erasable toner image formed on the paper, the system control section 5 controls the fixing device 29 to the color erasing temperature. The fixing device 29 controlled to the color erasing temperature presses and heats the paper transferred with the color erasable toner image at the color erasing temperature. The fixing device 29 conveys the paper subjected to color erasing processing to the paper discharge section 30 or the automatic double-sided unit (ADU) 31.

For example, in a case of confirming the color erasing state (color erasing residual) based on the color erasing processing, the paper subjected to color erasing processing by the fixing device 29 is resupplied to the image reading position of the scanner 23. In this case, the system control section 5 conveys the paper subjected to color erasing processing by the fixing device 29 to the ADU 31 instead of the paper discharge section 30. The ADU 31 conveys the paper subjected to color erasing processing by the fixing device 29 to the image reading position of the scanner 23 again. The scanner 23 reads the image on the resupplied paper. The system control section 5 conveys the paper of which the color erasing state is confirmed according to the image read by the scanner 23 to the paper discharge section 30.

The operation panel 4 is a user interface. The operation panel 4 comprises a display section 4*a* which includes various buttons and a touch panel 4*b*. The system control section 5 controls the content to be displayed on the display section 4*a* of the operation panel 4. Further, the operation panel 4 outputs information input through the touch panel 4*b* or the buttons of the display section 4*a* to the system control section 5. A user designates an operation mode, or inputs information such as setting information and the like in the operation panel 4. For example, the operation panel 4 receives a designation on a paper security print as a print mode. The paper security print is a print mode for printing an image in a specific pattern such as a ground pattern and the like for preventing duplication (copy) (hereinafter, referred to as specific pattern), and an image (printing image) serving as a protection target. Further, in the operation panel 4, a designation on whether to print the specific pattern with general toner (color inerasable) or color erasable toner (color erasable) can be received as a setting of the paper security print.

Next, the constitution of the control system of the digital multi-functional peripheral is described.

Figure 2:
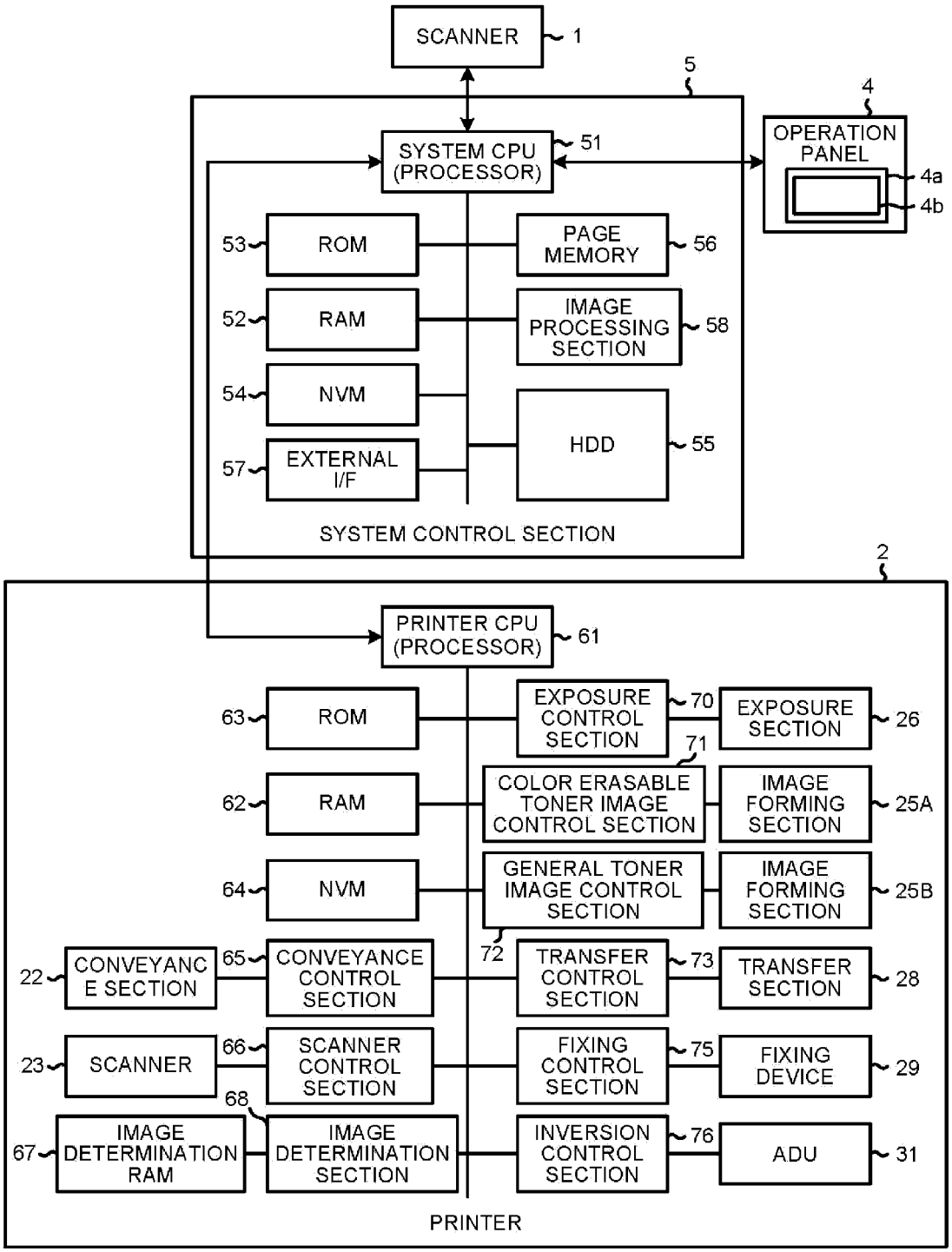
FIG. 2 is a block diagram illustrating a constitution example of a control system in the digital multi-functional peripheral according to the embodiment.

FIG. 2 is a block diagram schematically illustrating a constitution example of the control system in the system control section 5 and the printer 2 of the digital multi-functional peripheral.

In the constitution example shown in FIG. 2, the system control section 5 comprises a system CPU (processor) 51, a RAM 52, a ROM 53, a non-volatile memory (NVM) 54, a HDD 55, a page memory 56, an external interface (I/F) 57 and an image processing section 58.

The system CPU 51 uniformly controls the whole digital multi-functional peripheral and each section. The system CPU 51, which is a processor realizing processing by executing programs, is connected with each section of the system control section 5 through a system bus. In addition to each section of the system control section 5, the system CPU 51 is also connected with the scanner 1, the printer 2, the operation panel 4 and the like through the system bus. The system CPU 51 outputs an operation instruction to each section and acquires various kinds of information from each section through a bidirectional communication with the scanner 1, the printer 2 and the operation panel 4. Further, the system CPU 51 inputs information representing detection signals of various sensors arranged in each section of the system control section 5, an operation state and the like.

The RAM 52 consists of a volatile memory. The RAM 52 functions as a working memory or a buffer memory. The ROM 53 is an unrewritable non-volatile memory for storing programs, control data and the like. The system CPU 51 realizes various processing by executing the programs stored in the ROM 53 (or the non-volatile memory 54 or the HDD 55) while using the RAM 52. For example, the system CPU 51 functions as an extraction unit and a control unit by executing the programs.

The non-volatile memory (NVM) 54 is a rewritable non-volatile memory which stores the control programs executed by the system CPU 51 and the control data. Further, the non-volatile memory 54 stores the setting information, processing condition and the like. The hard disk drive (HDD) 55 is a high-capacity storage device. The HDD 55 stores the image data, various kinds of operation history information and the like. Further, the HDD 55 may also store the control programs, the control data and the like, or store the setting information, the processing condition and the like.

The page memory 56 is a memory for developing the image data to be processed. For example, in a case of carrying out copy processing, the page memory 56 stores the image data which is read by the scanner 1 and is subjected to the image processing for scanning. The system CPU 51 carries out the image processing for printing on the image data stored in the page memory 56, and outputs the processed image data to the printer 2. Further, the system CPU 51 stores the image data stored in the page memory 56 in the HDD 55, or sends the image data to an external device through the external interface 57.

The external interface (I/F) 57 is an interface for communicating with the external device. For example, the external interface 57 receives print data corresponding to a print request from the external device. The external interface 57 may be an interface for carrying out data notification with the external device, for example, the external interface 57 may be an interface locally connected with the external device, or a network interface for communicating through a network.

The image processing section 58 has functions such as an image processing section of a scanner system for carrying out an image processing on the image data read by the scanner 1, a compression and expansion section for carrying out compression or expansion processing on the image data, an image processing section of a printer system for generating the image data for printing to be printed by the printer 2 on a paper and the like. For example, as the image processing section of a scanner system, the image processing section 58 has functions such as shading correction processing, gradation conversion processing, inter-line correction processing and the like.

Next, a constitution example of the control system in the printer 2 is described.

In the constitution example shown in FIG. 2, the printer 2 comprises, as the constitution of the control system, a printer CPU (processor) 61, a RAM 62, a ROM 63, a non-volatile memory (NVM) 64, a conveyance control section 65, a scanner control section 66, an image determination RAM 67, an image determination section 68, an exposure control section 70, a color erasable toner image control section 71, a general toner image control section 72, a transfer control section 73, a fixing control section 75 and an inversion control section 76 and the like.

The printer CPU 61 controls the whole printer 2. The printer CPU 61, which is a processor realizing processing by executing programs, is connected with each section of the printer 2 through a system bus and the like. The printer CPU 61 outputs, in response to the operation instruction from the system CPU 51, an operation instruction to each section of the printer 2, and notifies various kinds of information acquired from each section to the system CPU 51.

The RAM 62 consists of a volatile memory. The RAM 62 functions as a working memory or a buffer memory. The ROM 63 is an unrewritable non-volatile memory for storing programs, control data and the like. The printer CPU 61 realizes various processing by executing the programs stored in the ROM 63 (or the non-volatile memory 64) while using the RAM 62.

The non-volatile memory (NVM) 64 is a rewritable non-volatile memory which stores, for example, the control programs executed by the printer CPU 61 and the control data. Further, the non-volatile memory 64 stores the setting information, processing condition and the like.

The conveyance control section 65 controls the paper conveyance in the printer 2 and the driving of the pickup rollers 21 and the conveyance section 22. The conveyance control section 65 controls the driving of the conveyance rollers serving as the conveyance section 22 in the printer 2 in response to the operation instruction from the printer CPU 61. For example, the printer CPU 61 instructs, in response to an instruction of starting image erasing processing or image forming processing from the system control section 5, the conveyance control section 65 to start to feed a paper by driving the pickup rollers 21 and the conveyance section 22.

The scanner control section 66 controls the driving of the scanner 23. The scanner control section 66 reads the image on the paper in response to the operation instruction from the printer CPU 61. For example, the scanner control section 66 reads, using the scanner 23, the image on the paper detected by a sensor (not shown) at the image reading position of the scanner 23. Further, the scanner control section 66 transfers the image data read by the scanner 23 to the system control section 5. The system control section 5 stores the image data of the paper read by the scanner 23 in the HDD 55. Further, the system control section 5 may also determine the color erasing state (color erasing residual) of the image on the paper based on the image data read by the scanner 23.

The exposure control section 70 controls the exposure section 26. The exposure control section 70 forms, using the exposure section 26, an electrostatic latent image on the photoconductive drum of each image forming section 25*e*Y, 25*e*M, 25*e*C, 25*e*K, 25K in response to the operation instruction from the printer CPU 61. For example, the exposure control section 70 controls, in response to the image data instructed by the printer CPU 61, the laser light irradiated to each photoconductive drum by the exposure section 26.

The color erasable toner image control section 71 controls the driving of each image forming section 25*e*Y, 25*e*M, 25*e*C, 25*e*K serving as the first image forming section. The color erasable toner image control section 71 develops, in response to the operation instruction from the printer CPU 61, the electrostatic latent image on the photoconductive drum of each image forming section 25*e*Y, 25*e*M, 25*e*C, 25*e*K with color erasable toner of each color. The general toner image control section 72 controls the driving of the image forming section 25K serving as the second image forming section. The general toner image control section 72 develops, in response to the operation instruction from the printer CPU 61, the electrostatic latent image on the photoconductive drum of the image forming section 25K with the general toner. The transfer control section 73 controls the driving of the transfer section 28 and the transfer current and the like. The transfer control section 73 transfers, in response to operation instruction from the printer CPU 61, the toner image transferred to the intermediate transfer belt 27 to the paper using the transfer section 28.

The fixing control section 75 controls the driving of the fixing device 29. The fixing control section 75 drives the heating roller 29*b* and the pressing roller 29*c* in response to the operation instruction from the printer CPU 61. Further, the fixing control section 75 controls the surface temperature of the heating roller 29*b* to a desired temperature by controlling the heating section 29*a*. The fixing control section 75 controls the surface temperature of the heating roller 29*b* to a temperature (fixing temperature or color erasing temperature) designated by the printer CPU 61. Further, the system control section 5 instructs the fixing temperature or the color erasing temperature corresponding to the operation mode to the printer CPU 61.

For example, in a case of fixing the color erasable toner on the paper (that is, a case of executing fixing processing of color erasable toner), the fixing control section 75 controls the heating section 29*a* such that the temperature of the heating roller 29*b* is the fixing temperature for fixing the color erasable toner. In a case of fixing the general toner image on the paper (that is, a case of executing fixing processing of general toner), the fixing control section 75 controls the heating section 29*a* such that the temperature of the heating roller 29*b* is the fixing temperature for fixing the general toner. Further, in a case of fixing the toner image containing the general toner and the color erasable toner on the paper (that is, in a case of executing fixing processing of the color erasable toner and the general toner), the fixing control section 75 controls the heating section 29*a* such that the temperature of the heating roller 29*b* is the fixing temperature for fixing the toner of which the fixing temperature is the highest in the general toner and the color erasable toner used by the heating roller 29*b*.

Further, in a case of erasing the color erasable toner image on the paper, the fixing control section 75 controls the heating section 29*a* such that the temperature of the heating roller 29*b* is the temperature (color erasing temperature) for the color erasing processing.

In addition, the color erasing temperature of the color erasable toner of each color is higher than the fixing temperature for fixing each color erasable toner and the fixing temperature for fixing the general toner. Further, the color erasable toner of each color may have different fixing temperature and different color erasing temperature. For example, in a case of carrying out fixing processing on the color erasable toners of different colors, the fixing control section 75 controls the surface temperature of the heating roller 29*b* to a fixing temperature for fixing the toner of which the fixing temperature is the highest in the used toners. In a case of carrying out color erasing processing on the color erasable toners of different colors, the fixing control section 75 controls the surface temperature of the heating roller 29*b* to a color erasing temperature for erasing the toner of which the color erasing temperature is the highest in the used toners.

The inversion control section 76 controls the driving of the ADU 31. The inversion control section 76 resupplies, in response to the operation instruction from the printer CPU 61, the paper passing through the fixing device 29 to the image reading position of the scanner 23 using the ADU 31. For example, in a case of forming an image on the back side of the paper subjected to the fixing processing (in a case of duplex printing), the inversion control section 76 carries out a driving control such that the paper subjected to the fixing processing is temporarily conveyed to the side of the paper discharge section 30, and then is switched back to be conveyed to the ADU 31. The ADU 31 resupplies the paper switched back by the paper discharge section 30 to the register roller 24. In this way, the paper is resupplied to the register roller 24 in an inverted state. Further, in a case of confirming the color erasing state of the image on the paper subjected to the color erasing processing by the fixing device 29, the inversion control section 76 carries out a driving control such that the paper subjected to the color erasing processing is conveyed to the ADU 31 in a state as it is. The ADU 31 conveys the paper in a state as it is and resupplies the paper to the image reading position of the scanner 23. In this way, the paper is resupplied to the image reading position of the scanner 23 in a state as it is, that is, in a state where the front side and the back side of the paper are not inverted.

Next, the operations of the digital multi-functional peripheral are described.

Herein, the operations in the paper security print are described. The paper security print is a print mode for overprinting the specific pattern for preventing duplication on an image (hereinafter, referred to as a protection image) serving as a protection target. In the paper security print, the printer 2 has, as printing setting of the specific pattern, a first mode in which the specific pattern is formed with general toner, a second mode in which the specific pattern is formed with color erasable toner and a third mode for a user to select the first mode or the second mode.

In addition, in the present embodiment, an operation example in a case where the protection image is printed with color erasable toner in the paper security print is described. However, in different application forms, the printing setting and operation of the specific pattern which will be described later may also be carried out, regardless of the setting of the toner for printing the protection image.

Figure 3:
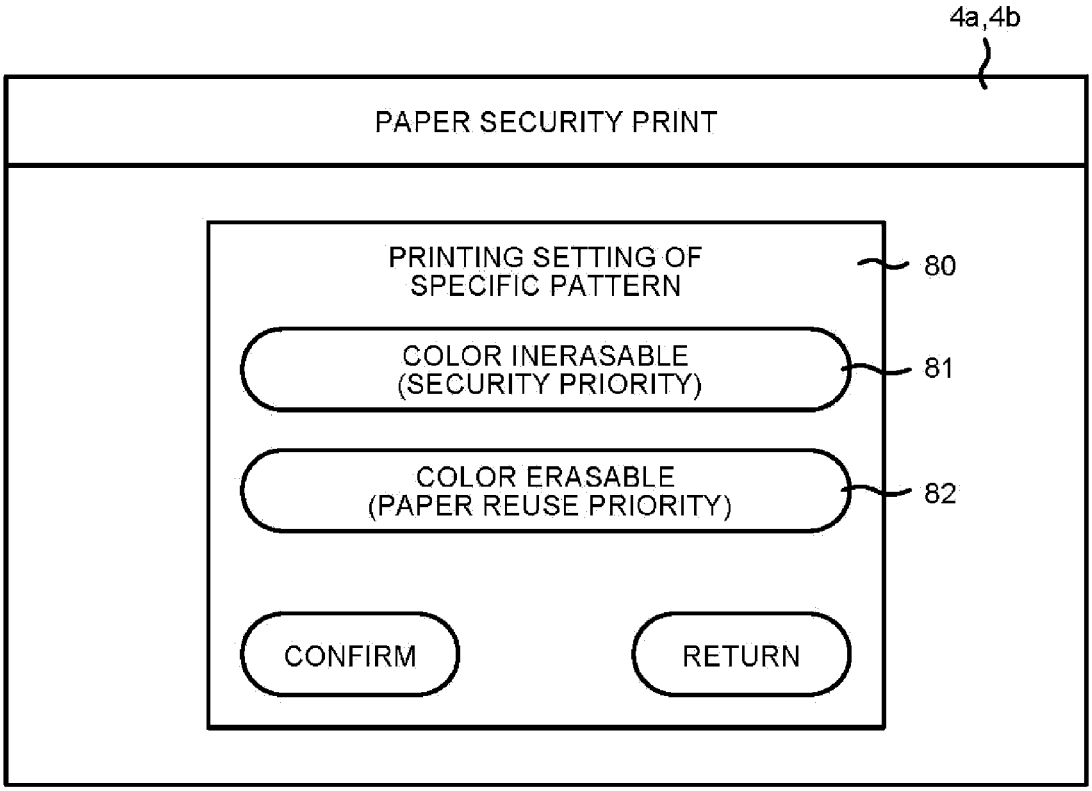
FIG. 3 is a display example of a printing setting screen displayed on a display section by the digital multi-functional peripheral according to the embodiment.

FIG. 3 is a display example of a setting screen of the paper security print to be displayed on the display section 4*a* of the operation panel 4.

FIG. 3 illustrates a display example of a printing setting screen 80 of the specific pattern in the paper security print. In the display example shown in FIG. 3, the display section 4*a* displays, in the printing setting screen 80 of the specific pattern, a first icon 81 and a second icon 82 which can be selected through the touch panel 4*b*. Further, in the display example shown in FIG. 3, the display section 4*a* of the operation panel 4 displays 'color inerasable (security priority)' in the first icon 81, and 'color erasable (paper reuse priority)' in the second icon 82.

The first icon 81 is an icon for setting to print the specific pattern with the general toner. For example, if the first icon 81 is selected, the printer 2 prints the specific pattern with the general toner as the paper security print. As the color of the specific pattern cannot be erased, the paper on which the specific pattern is printed with the general toner is high in security, however, low in reusability.

The second icon 82 is an icon for setting to print the specific pattern with the color erasable toner. If the second icon 82 is selected, the printer 2 prints the specific pattern on the paper with the color erasable toner in the paper security print. As the color of the specific pattern can be erased, the paper on which the specific pattern is printed with the color erasable toner is low in security, however, high in reusability.

That is, in the printing setting screen 80 of the specific pattern shown in FIG. 3, the user selects, if desiring to prioritize the security of the paper and desiring to make the specific pattern inerasable, the first icon 81 in which 'color inerasable' is displayed, and selects, if desiring to prioritize the reusability of the paper and make the specific pattern erasable, the second icon 82 in which 'color erasable' is displayed. In this way, in the printer according to the present embodiment, the printing setting of the specific pattern corresponding to the desire of the user can be carried out in the paper security print.

Next, the operation example of the paper security print in the digital multi-functional peripheral is described.

Figure 4:
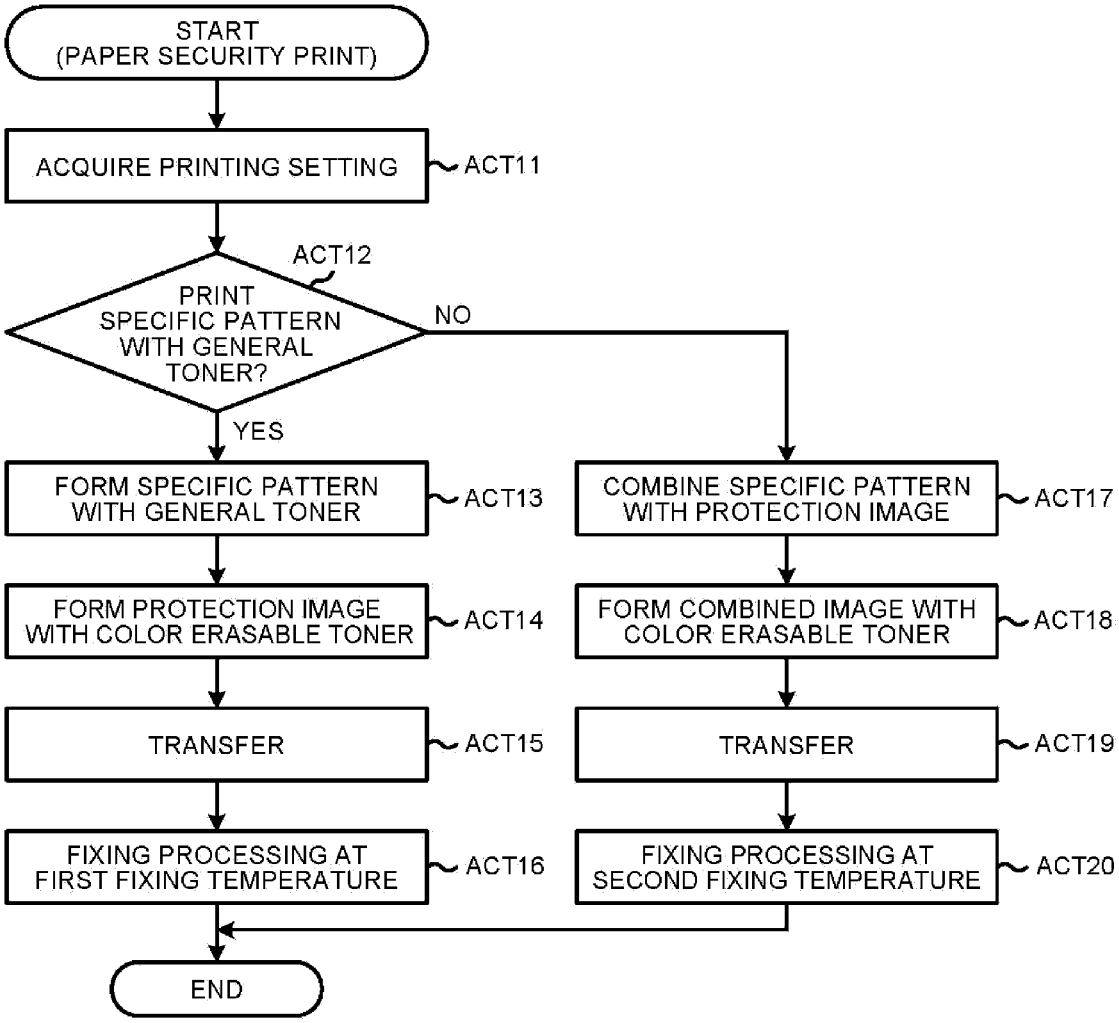
FIG. 4 is a flowchart illustrating an operation example of a paper security print in the digital multi-functional peripheral according to the embodiment.

FIG. 4 is a flowchart illustrating the operation example of the paper security print in the digital multi-functional peripheral.

If the paper security print is instructed as the print mode through the operation panel 4, the system control section 5 displays the setting screen of the paper security print on the display section 4*a* of the operation panel 4. For example, the display section 4*a* of the operation panel 4 displays the setting screen shown in FIG. 3 as the printing setting screen of the specific pattern. A user instructs to start the printing after inputting various printing setting of the paper security print through the operation panel 4. If the start of the printing is instructed, the system control section 5 acquires printing setting information including the printing setting for the specific pattern (ACT 11). If the printing setting information is acquired, the system control section 5 determines whether to form the specific pattern with the general toner or the color erasable toner according to the acquired printing setting information (ACT 12).

If it is determined to print the specific pattern with the general toner (YES in ACT 12), the system control section 5 forms the image of the specific pattern with the general toner (ACT 13). In a case where color printing can be carried out with the general toner, the specific pattern may be printed with any color of the general toner, or be printed with general toners of different colors. In ACT 13 in the present embodiment, the specific pattern is assumed to be printed with black general toner.

That is, in a case of forming the specific pattern with the general toner, the system control section 5 converts the image of the specific pattern into printing image data. The system control section 5 supplies the printing image data of the specific pattern to the printer 2 as the image data which will be used by the image forming section (image forming section using the general toner (the second image forming section)) 25K to form an image. The printer CPU 61 of the printer 2 controls the image forming section 25K based on the printing image data of the specific pattern using the general toner image control section 72. In this way, the image forming section 25K forms the image of the specific pattern with the general toner image.

Further, the system control section 5 forms the protection image serving as an image to be printed with the color erasable toner (ACT 14). That is, the system control section 5 converts the protection image (image to be printed) into the printing image data. For example, in a case of printing the protection image with the color erasable toners of different colors (color erasable toner of each color), the system control section 5 converts the protection image (image to be printed) into the printing image data of each color. Further, in a case of printing the protection image with the monochrome (black) color erasable toner, the system control section 5 converts the protection image (image to be printed) into the monochrome printing image data.

After converting the protection image into the printing image data, the system control section 5 supplies the printing image data of the protection image to the printer 2 as the image data which will be used by the image forming sections (image forming sections using the color erasable toner (the first image forming section)) 25*e*Y, 25*e*M, 25*e*C, 25*e*K to form an image. The printer CPU 61 of the printer 2 controls each image forming section 25*e*Y, 25*e*M, 25*e*C, 25*e*K based on the printing image data of each color. In this way, each image forming section 25*e*Y, 25*e*M, 25*e*C, 25*e*K forms the image of each color constituting the protection image with the color erasable toner image.

After the general toner image of the specific pattern and the color erasable toner image of the protection image are formed, the general toner image control section 72 and the color erasable toner image control section 71 superimpose and transfer the general toner image of the specific pattern and the color erasable toner image of the protection image to the intermediate transfer belt 27 through each image forming section 25K, 25*e*Y, 25*e*M, 25*e*C, 25*e*K. The transfer control section 73 transfers, using the transfer section 28, the toner image (mixed toner image) obtained by overlapping the general toner image (specific pattern) on the color erasable toner image (protection image) on the intermediate transfer belt 27 to the paper supplied from the register roller 24 (ACT 15).

Further, in order to fix the mixed toner image obtained by overlapping the general toner image on the color erasable toner image on the paper, the printer CPU 61 sets the fixing temperature (first fixing temperature) for fixing the toner of which the fixing temperature is the highest in those toners in the fixing control section 75. For example, in a case where the fixing temperature of the general toner is higher than that of the color erasable toner of each color, the printer CPU 61 sets, in the fixing control section 75, the fixing temperature for fixing the general toner as the first fixing temperature.

After the first fixing temperature is set, the fixing control section 75 controls the heating section 29*a* such that the surface temperature of the heating roller 29*b* is the first fixing temperature. If the surface temperature of the heating roller 29*b* becomes the first fixing temperature, the fixing control section 75 drives the heating roller 29*b* and the pressing roller 29*c* to carryout fixing processing on the paper which is supplied from the transfer section 28 and is transferred with the mixed toner image (ACT 16).

Through the processing in ACTs 13~16, the printer 2 prints the image obtained by overlapping the specific pattern formed with the general toner on the protection image formed with the color erasable toner on the paper. As the specific pattern formed with the general toner cannot be erased, the security of the paper is high.

Further, if it is determined to print the specific pattern with the color erasable toner (NO in ACT 12), the system control section 5 generates the printing image data of the color erasable toner which is obtained by combining the image of the specific pattern with the protection image (ACT 17). After the printing image data of the color erasable toner obtained by combining the specific pattern is generated, the printer 2 forms, using the image forming sections (image forming sections using the color erasable toner (the first image forming section)) 25*e*Y, 25*e*M, 25*e*C, 25*e*K, the specific pattern and the protection image with the color erasable toner (ACT 18). In a case where color printing can be carried out with the color erasable toner, the specific pattern may be printed with any color of the color erasable toner, or be printed with color erasable toners of different colors.

In addition, the specific pattern may also be formed with a color erasable toner the color of which is the hardest to erase in the color erasable toner of each color (for example, the color erasable toner having the highest color erasing temperature), or a color erasable toner which has the most color erasing residues after the color erasing processing in the color erasable toner of each color. In this way, a situation will hardly occur where the protection image is left on the paper while only the specific pattern is erased after the color erasing processing. In the description of the present embodiment, the specific pattern is assumed to be printed with black color erasable toner.

If it is determined to print the specific pattern with the color erasable toner, the system control section 5 converts the image of the specific pattern into the printing image data. Further, the system control section 5 converts the protection image (image to be printed) into the printing image data. The system control section 5 combines the printing image data of the specific pattern with the printing image data of the protection image. The image data obtained by combining the printing image data of the specific pattern with the printing image data of the protection image is the printing image data of the color erasable toner.

For example, in a case of printing the protection image with the color erasable toner of one color (for example, black), and printing the specific pattern with the color erasable toner of one color (for example, black), the system control section 5 combines the black printing image data of the specific pattern with the black printing image data of the protection image (image to be printed). As a result, the system control section 5 generates the printing image data of the color erasable toner of one color (black) as the printing image data for the color erasable toner.

Further, in a case of printing the protection image with color erasable toners of different colors (color erasable toners of a plurality of colors) and printing the specific pattern with the color erasable toner of one color (for example, black), the system control section 5 combines the black printing image data of the specific pattern with the black printing image data in the printing image data of each color constituting the color protection image (image to be printed). As a result, the system control section 5 generates, as the printing image data for the color erasable toner, the printing image data of black color erasable toner obtained by combining the specific pattern, and the printing image data of the color erasable toner of each color except black constituting the protection image.

Further, in a case of printing the protection image with the color erasable toner of one color (for example, black), and printing the specific pattern with the color erasable toners of different colors (color erasable toners of a plurality of colors), the system control section 5 combines the black printing image data of the specific pattern with the black printing image data of the protection image (image to be printed). As a result, the system control section 5 generates, as the printing image data for the color erasable toner, the printing image data of the black color erasable toner obtained by combining the specific pattern and the protection image, and the printing image data of the color erasable toner of each color except black constituting the specific pattern.

Further, in a case of printing the protection image with the color erasable toners of different colors (color erasable toner of each color), and printing the specific pattern with the color erasable toners of different colors, the system control section 5 combines the printing image data of each color constituting the color specific pattern with the printing image data of each color constituting the color protection image (image to be printed) for each color. As a result, the system control section 5 generates, as the printing image data for the color erasable toner, the printing image data of the color erasable toner of each color obtained by combining the specific pattern with the protection image for each color.

The system control section 5 supplies the printing image data for the color erasable toner obtained by combining the specific pattern with the protection image to the printer 2. The printer 2 forms, using the image forming sections (image forming sections using the color erasable toner (the first image forming section)) 25*e*Y, 25*e*M, 25*e*C, 25*e*K, a color erasable toner image based on the printing image data for the color erasable toner (ACT 18). That is, the printer CPU 61 of the printer 2 controls, using the color erasable toner image control section 71, the image forming sections 25*e*Y, 25*e*M, 25*e*C, 25*e*K based on the printing image data for the color erasable toner (the printing image data of the combined image). In this way, the image forming sections 25*e*Y, 25*e*M, 25*e*C, 25*e*K form the combined image obtained by combining the specific pattern with the protection image with the color erasable toner image.

In addition, the system control section 5 may also respectively form the specific pattern and the protection image with the color erasable toner, and then superimpose and transfer the images to the intermediate transfer belt 27. In this case, the system control section 5 may respectively carries out the processing of forming the specific pattern with the color erasable toner and the processing of forming the protection image with the color erasable toner.

After the color erasable toner image obtained by combining the specific pattern with the protection image is formed, the general toner image control section 72 transfers, using each image forming section 25*e*Y, 25*e*M, 25*e*C, 25*e*K, the color erasable toner image of the specific pattern and the protection image to the intermediate transfer belt 27. The transfer control section 73 transfers, using the transfer section 28, the color erasable toner image (the specific pattern and the protection image) on the intermediate transfer belt 27 to the paper supplied from the register roller 24 (ACT 19).

Further, the printer CPU 61 sets the fixing temperature (second fixing temperature) for fixing the color erasable toner in the fixing control section 75. For example, in a case of forming the color erasable toner image with color erasable toners of a plurality of colors, the printer CPU 61 sets, in the fixing control section 75, the fixing temperature (second fixing temperature) for fixing the toner of which the fixing temperature is the highest in the used color erasable toners.

After the second fixing temperature is set, the fixing control section 75 controls the heating section 29*a* such that the surface temperature of the heating roller 29*b* is the second fixing temperature. If the surface temperature of the heating roller 29*b* becomes the second fixing temperature, the fixing control section 75 drives the heating roller 29*b* and the pressing roller 29*c* to carry out fixing processing on the paper which is supplied from the transfer section 28 and is transferred with the color erasable toner image (ACT 20).

Through the processing in ACTs 17~20, the printer 2 prints the specific pattern and the protection image on the paper with the color erasable toner. In this case, both the specific pattern and the protection image formed on the paper with the color erasable toner can be erased. Therefore, the paper can be reused after color erasing processing.

While certain embodiments have been described, these embodiments have been presented by way of example only, and are not intended to limit the scope of the invention. Indeed, the novel embodiments described herein may be embodied in a variety of other forms; furthermore, various omissions, substitutions and changes in the form of the embodiments described herein may be made without departing from the spirit of the invention. The accompanying claims and their equivalents are intended to cover such forms or modifications as would fall within the scope and spirit of the invention.

What is claimed is:

1. An image forming apparatus, comprising:

a first image forming unit configured to form an image using an erasable image forming material;

a second image forming unit configured to form an image using an inerasable image forming material;

a processing unit configured to form an image to be printed using an erasable image forming material with the first image forming unit, and form a specific pattern for duplication prevention using an inerasable image forming material or an erasable image forming material with the second image forming unit; and a selection unit configured to select whether to form the specific pattern using the erasable image forming material or the inerasable image forming material; wherein the processing unit forms, in a case where the selection unit selects to form the specific pattern using the inerasable image forming material, the specific pattern using the inerasable image forming material with the second image forming unit, and forms, in a case where the selection unit selects to form the specific pattern using the erasable image forming material, the specific pattern using the erasable image forming material with the first image forming unit.

2. The image forming apparatus according to claim 1, wherein the erasable image forming material is a material which can be erased when heated at a given erasing temperature, and the inerasable image forming material is a material which cannot be erased when heated at the erasing temperature.

3. The image forming apparatus according to claim 1, wherein the first image forming unit forms a toner image using an erasable toner, and the second image forming unit forms a toner image using an inerasable toner;

further comprising:

a transfer unit configured to superimpose the toner image formed using the erasable toner with the first image forming unit on the toner image formed using the inerasable toner with the second image forming unit, and transfer a resulting image to an image formed medium; and a fixing unit configured to fix the toner image on the image formed medium which is transferred with a toner image by the transfer unit.

4. The image forming apparatus according to claim 3, wherein the erasable toner is a material which can be erased at a temperature above the erasing temperature, and the erasable toner and the inerasable toner are materials which can be fixed on the image formed medium at a fixing temperature lower than the erasing temperature.

5. An image forming apparatus, comprising:

a first printer configured to form an image using an erasable image forming material;

a second printer configured to form an image using an inerasable image forming material;

a first processor configured to form an image to be printed using an erasable image forming material with the first printer, and form a specific pattern for duplication prevention using an inerasable image forming material or an erasable image forming material with the second printer; and a second processor configured to select whether to form the specific pattern using the erasable image forming material or the inerasable image forming material: wherein the first processor forms, in a case where the second processor selects to form the specific pattern using the inerasable image forming material, the specific pattern using the inerasable image forming material with the second printer, and forms, in a case where the second processor selects to form the specific pattern using the erasable image forming material, the specific pattern using the erasable image forming material with the first printer.

6. The image forming apparatus according to claim 5, wherein the erasable image forming material is a material which can be erased when heated at a given erasing temperature, and the inerasable image forming material is a material which cannot be erased when heated at the erasing temperature.

7. The image forming apparatus according to claim 5, wherein the first printer forms a toner image using an erasable toner, and the second printer forms a toner image using an inerasable toner;

further comprising:

a transfer configured to superimpose the toner image formed using the erasable toner with the first printer on the toner image formed using the inerasable toner with the second printer, and to transfer a resulting image to an image formed medium; and a fixer configured to fix the toner image on the image formed medium which is transferred with a toner image by the transfer.

8. The image forming apparatus according to claim 7, wherein the erasable toner is a material which can be erased at a temperature above the erasing temperature, and the erasable toner and the inerasable toner are materials which can be fixed on the image formed medium at a fixing temperature lower than the erasing temperature.

9. An image forming method, comprising:

selecting whether to form a specific pattern for duplication prevention using an erasable image forming material or an inerasable image forming material;

forming the specific pattern using the inerasable image forming material, if forming the specific pattern using the inerasable image forming material is selected; and forming the specific pattern using the erasable image forming material, if forming the specific pattern using the erasable image forming material is selected.

10. The image forming method according to claim 9, wherein the erasable image forming material is a material which can be erased when heated at a given erasing temperature, and the inerasable image forming material is a material which cannot be erased when heated at the erasing temperature.

11. The image forming method according to claim 9, further comprising:

superimposing a toner image formed using an erasable toner on a toner image formed using an inerasable toner;

transferring a resulting image to an image formed medium; and fixing the toner image on the image formed medium which is transferred with a toner image.

12. The image forming method according to claim 11, wherein the erasable toner is a material which can be erased at a temperature above the erasing temperature, and the erasable toner and the inerasable toner are materials which can be fixed on the image formed medium at a fixing temperature lower than the erasing temperature.

* * * * *